US005507049A

United States Patent [19]

Lane

[11] Patent Number: 5,507,049

[45] Date of Patent: Apr. 16, 1996

[54] LANCE SUPPORTS

[76] Inventor: Florida C. Lane, 8934 Glacier St., West Texas City, Tex. 77591

[21] Appl. No.: 285,100

[22] Filed: Aug. 3, 1994

[51] Int. Cl.[6] ..... A47G 9/00; A47C 20/00

[52] U.S. Cl. ..... 5/484; 5/485; 5/630; 5/473

[58] Field of Search ..... 5/630, 632, 484, 5/485, 490, 495, 496, 497, 473

[56] References Cited

U.S. PATENT DOCUMENTS

| | | | |
|---|---|---|---|
| 2,460,452 | 2/1949 | Hampton | 5/490 |
| 2,778,413 | 1/1957 | Katzner | 5/490 |
| 3,454,969 | 7/1969 | Lundberg | 5/484 |
| 5,144,911 | 9/1992 | Moore | 5/490 |
| 5,193,238 | 3/1993 | Clute | 5/490 |
| 5,265,294 | 11/1993 | McClure | 5/473 |
| 5,331,699 | 7/1994 | Patton | 5/490 |

*Primary Examiner*—Flemming Saether

[57] ABSTRACT

Lance supports including a series of pillowlike supports for post surgical use including a wedge shaped back support, a rectangularly shaped leg support, a rectangularly shaped abdominal support, and a skirted cylindrical shaped infantile back support. In general, the lance supports comprise substantially firm pillows having a foam core, a first impermeable membranous covering layer, and a second washable fabriclikle outer covering layer.

1 Claim, 4 Drawing Sheets

LANCE SUPPORTS

BACKGROUND OF THE INVENTION

1. Field of the Invention

The present invention relates to post surgery support pillows and more particularly pertains to pillow support device which may be employed to provide support of various human body portions after surgery.

2. Description of the Prior Art

The use of post surgery support pillows is known in the prior art. More specifically, post surgery support pillows heretofore devised and utilized for supporting various human body portions after surgery are known to consist basically of familiar, expected and obvious structural configurations, notwithstanding the myriad of designs encompassed by the crowded prior art which have been developed for the fulfillment of countless objectives and requirements.

The present invention is directed to improving devices for lance supports in a manner which is safe, secure, economical and aesthetically pleasing.

For example, U.S. Pat. No. 4,020,511 to Terry discloses a foam bed pillow comprising a one piece substantially rectangular solid bed pillow having rounded corners of molded polyurethane composition having a low resistance to light loads and an increasing resistance to increasing loads. The Terry patent comprises a pillow useful for substantially non surgical use as a common bed pillow. The present invention comprises a series of pillows devised for employment as post surgical supports for various human body portions.

In U.S. Pat. No. Des. 309,544 to Abriam the ornamental design of a post-surgery pillow is disclosed. The Abriam patent comprises a butterfly shaped pillow employed for post surgery use. The present invention comprises pillowlike supports for post surgery use by human patients wherein none of the supports are butterfly shaped.

In U.S. Pat. No. 5,038,432 to Robillard et al. a compartmented orthopedic cervical pillow is described. The Robillard et al. invention is devised to support the neck and head of a person and is not generally employed as a post surgery support. The present invention comprises a series of post surgery support pillows of which none are designed to provide cervical support of the neck region.

In U.S. Pat. No. 4,970,742 to Keener a multi-sectional back rest and pillow having the capability of assuming a series of different configurations is disclosed for providing a general pillowlike rest having a multiplicity of differing configurations. A disadvantage in this prior art lies in a lack of support appropriate to post surgery support of various human body portions such as a between leg support or an infant support. The present invention comprises a series of post surgery pillow supports used for supporting various human body portions including legs and infantile shapes.

U.S. Pat. No. 4,969,222 to Serola discloses a contoured support pillow. The disclosure teaches a pillow for supporting the chest and shoulders of a prone patient comprising a rectangular base having one end extending arcuately upwardly and over the base to form a narrow ridged top and a downwardly extending portion connecting the base. The disclosure makes no provision for supporting other portions of a human body such as a leg or abdomen. Furthermore, there are no provisions for post surgery support of an infant human. The present invention comprises a series of post surgery supports for adult and infantile humans wherein a back support, a leg support, an abdominal support, and a newborn infant side support are disclosed.

In this respect, the lance supports according to the present invention substantially departs from the conventional concepts and designs of the prior art, and in so doing provides an apparatus primarily developed for the purpose of providing post surgery support of human body portions.

Therefore, it can be appreciated that there exists a continuing need for new and improved post surgery support pillows which can be employed to support portions of a human body after surgery to maintain particular body dispositions to promote healing, reduce pain, and prevent choking. In this regard, the present invention substantially fulfills this need.

As illustrated by the background art, efforts are continuously being made in an attempt to improve post surgery support pillows. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of post surgery support pillows now present in the prior art, the present invention provides an improved pillow support devices construction wherein the same can be utilized for providing post surgery support of portions of a human body. As such, the general purpose of the present invention, which will be described subsequently in greater detail, is to provide a new and improved pillow support devices apparatus and method which has all the advantages of the prior art post surgery support pillows and none of the disadvantages.

The invention is defined by the appended claims with the specific embodiment shown in the attached drawings. For the purpose of summarizing the invention, the invention may be incorporated into a first pillowlike support comprising a firm wedgelike member wherein an angular disposition of a sloping portion thereof supportively engaging a back of a human ranges from twenty five degrees to ninety degrees with respect to true horizontal, a second pillowlike support comprising a firm substantially rectangular member disposed between portions of the user's legs, a third pillowlike support comprising a substantially rectangular member supportedly disposed upon the user's abdomen during coughing, and a fourth pillowlike support comprising an elongated cylindrical pillow member of diameter ranging from three inches to ten inches having a clothlike skirt affixed thereto wherein an infant is placed upon its side with back supportively engaging the cylindrical pillow member. Pillowlike members comprise an interior support material of foamed polymer composition, an impermeable membranous first covering, and an outer washable covering having a releasable hook and loop closure permitting covering removal for cleaning.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide improved pillow support devices for post surgery support of various portions of the human body.

It is therefore an additional object of the present invention to provide new and improved pillow support devices which have all the advantages of the prior art post surgery supports and none of the disadvantages.

It is another object of the present invention to provide a new and improved pillow support devices which may be easily and efficiently manufactured and marketed.

It is a further object of the present invention to provide new and improved pillow support devices which are of a durable and reliable construction.

An even further object of the present invention is to provide new and improved pillow support devices which are susceptible of a low cost of manufacture with regard to both materials and labor, and which accordingly are then susceptible of low prices of sale to the consuming public, thereby making such lance supports economically available to the buying public.

Still yet another object of the present invention is to provide new and improved pillow support devices which provide in the apparatuses and methods of the prior art some of the advantages thereof, while simultaneously overcoming some of the disadvantages normally associated therewith.

Still another object of the present invention is to provide new and improved pillow support devices which may be employed to provide post surgery support of the back of a human.

Yet another object of the present invention is to provide new and improved pillow support devices comprising pillowlike members having removable washable coverings Even still another object of the present invention is to provide new and improved pillow support devices capable of providing post surgical support of infants wherein lying on a side is promoted to avoid choking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
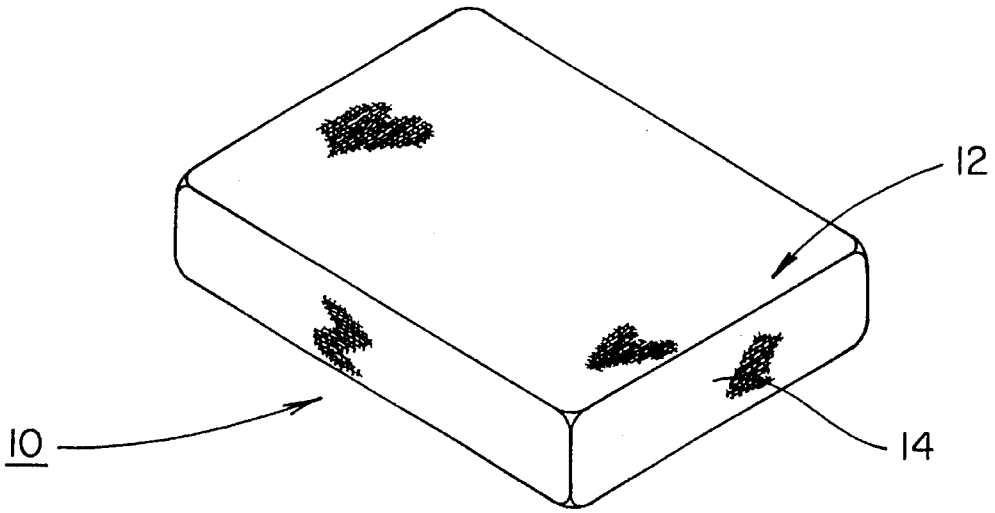
FIG. 1 is a perspective view of the pillow support devices showing a rectangular solid pillow.

With reference now to the drawings, and in particular to FIG. 1 thereof, new and improved pillow support device embodying the principles and concepts of the present invention and generally designated by the reference numeral 10 will be described.

From an overview standpoint, pillow support device 10 are adapted for use by human individuals recovering from surgery to provide support of various body portions . See FIG. 1. Pillow support device 10 comprises a support appliance in the form of a firm pillowlike member 12 of various shapes individually devised for support of the adult abdomen, legs, and back; and to maintain infants on their side. Pillowlike member 12 comprises a firm inner core enclosed by one or more covering layers of which an outer layer 14 may be fabriclike and have decorative patterns disposed thereon and an inner layer is impermeable to water, body fluids, and some solvents.

Figure 2:
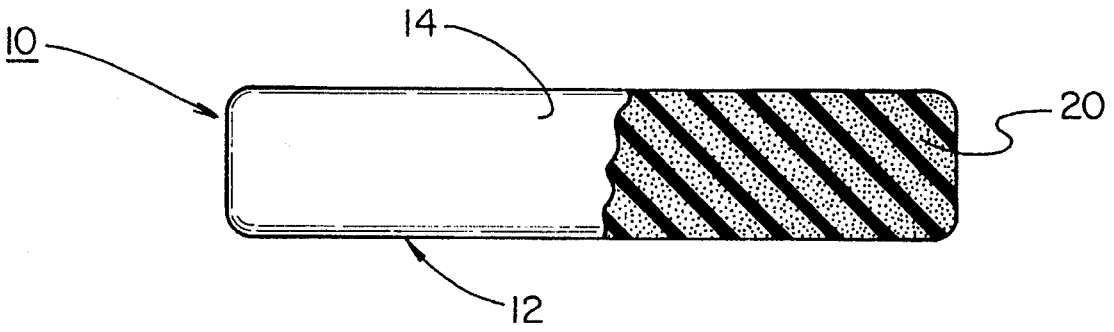
FIG. 2 is a cutaway side elevational view of the pillow support devices showing a rectangular solid pillow.

More specifically, it will be noted that pillow support device 10 comprises a firm pillowlike member 12 having a core 20 of foam polymeric or rubber composition. See FIG. 2. Candidate materials of core 20 construction include polystyrene type rigid foam, polyurethane rigid and semi-rigid foam, and latex or rubberlike semi-rigid foam, or combinations thereof. Core 20 may be substantially solid or may have vacant spaces disposed therein to provide structural support in specific interior regions.

Figure 3:
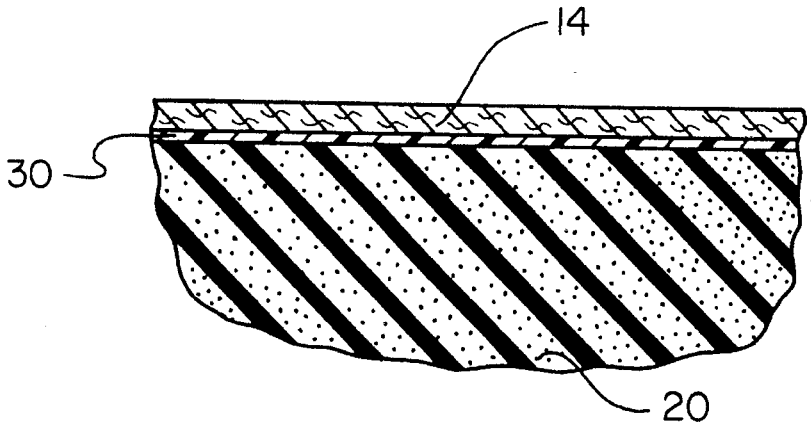
FIG. 3 is a fragmentary sectional view of the pillow support devices showing disposition of the covering and core materials.
Figure 4:
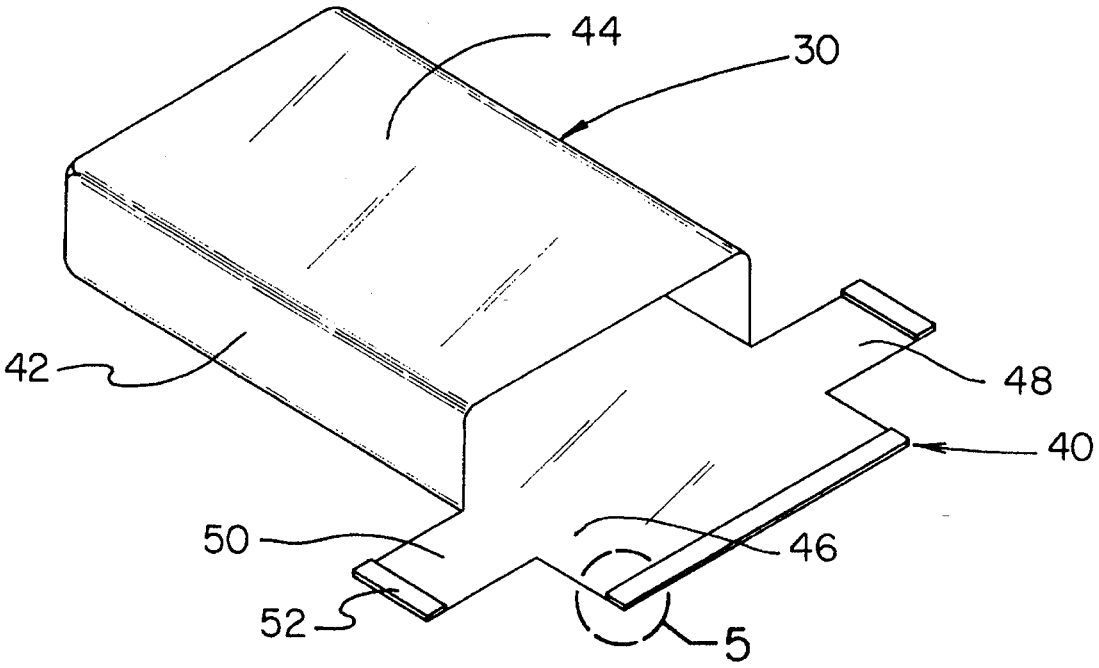
FIG. 4 is a perspective view of the pillow support devices showing a sealable impermeable covering member.
Figure 5:
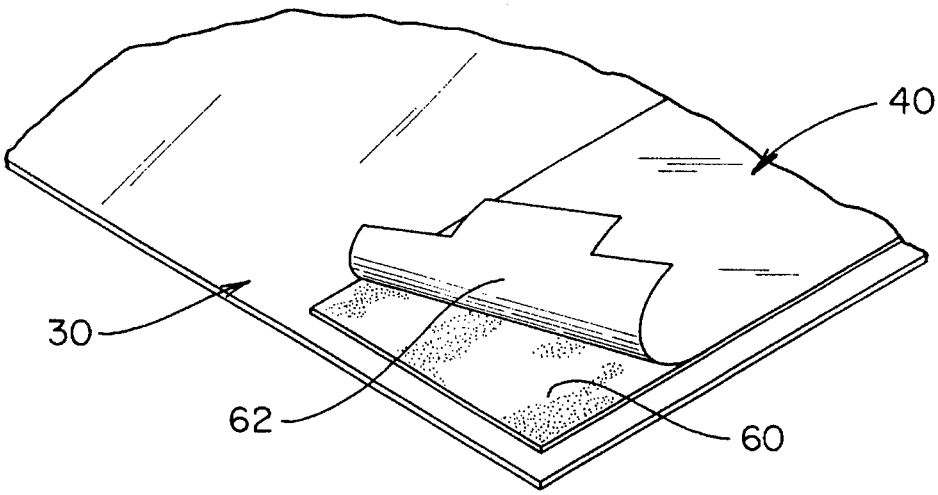
FIG. 5 is a fragmentary exploded perspective view of a pillow support devices showing a releasable adhesive member.

Core 20 is covered by a first impermeable membrane 30 which precludes water, body fluids, and several solvents from gaining access to core 20. See FIG. 3. Membrane 30 may be permanently affixed to core 20 or may be removably disposed provided that a suitable seal may be maintained. Membrane 30 may be of thin sheetlike rubber composition or polymeric composition such as vinyl. Seams may be sealed by exteriorly applied sealants, electrical welding, or adhesive strips 40 may be applied to seal seams thereof. See FIG. 4. Membrane 30 may be formed into a pouch 42 having five sealably closed sides 44 and a flaplike sixth side 46 having a first wing portion 48 and a second wing portion 50. First wing portion 48 and second wing portion 50 have disposed thereon additional adhesive strips 52. Adhesive strips 40 and 52 are substantially identical in construction and differ only in geometrical dimension as appropriate to the portion of membrane 30 to which attached. Adhesive strip 40 comprises a pressure sensitive adhesive layer 60 and a strippable protective layer 62. Pressure sensitive adhesive layer 60 comprises a layer adhering to membrane 30 on one side thereof and to strippable protective layer 62 on an opposing side thereof prior to use. In use, core 20 is insertedly disposed within membrane 30, protective layer 62 is stripped from the pressure sensitive adhesive layer 60, and membrane 30 is folded enclosing core 20. Pressure sensitive adhesive layer 60 is pressably disposed upon exterior portions of membrane 30 thereby sealing core 20 therewithin.

Figure 6:
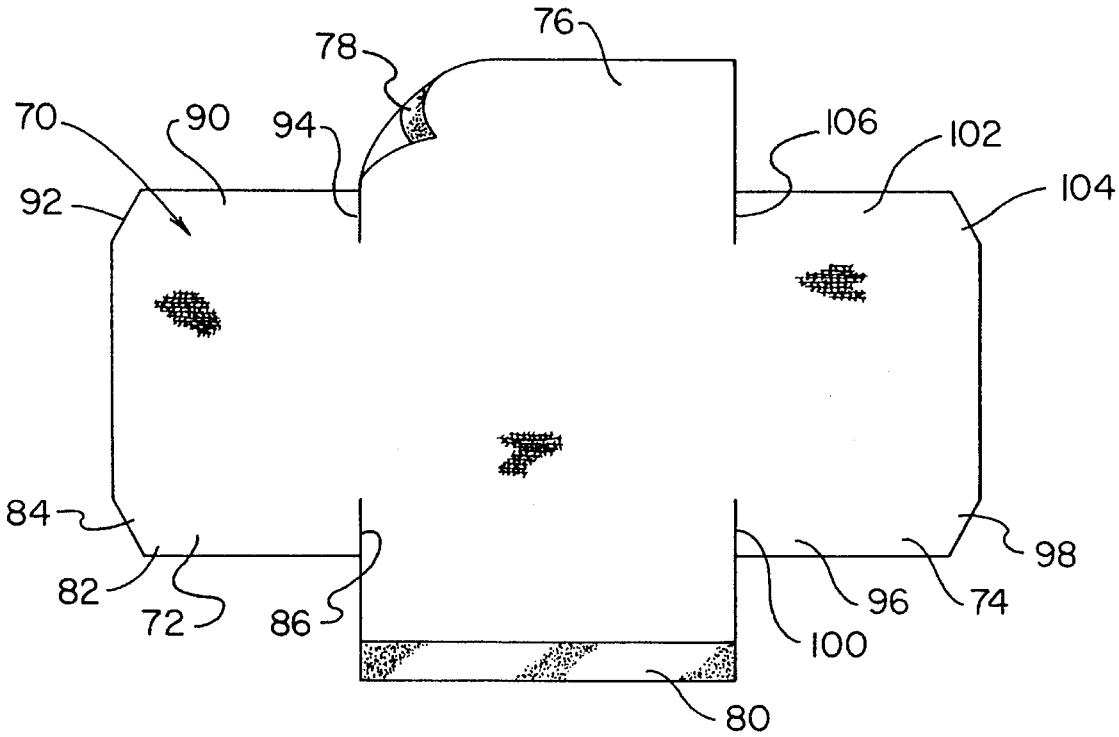
FIG. 6 is a side elevational view of the pillow support devices showing a fabriclike outer covering.
Figure 7:
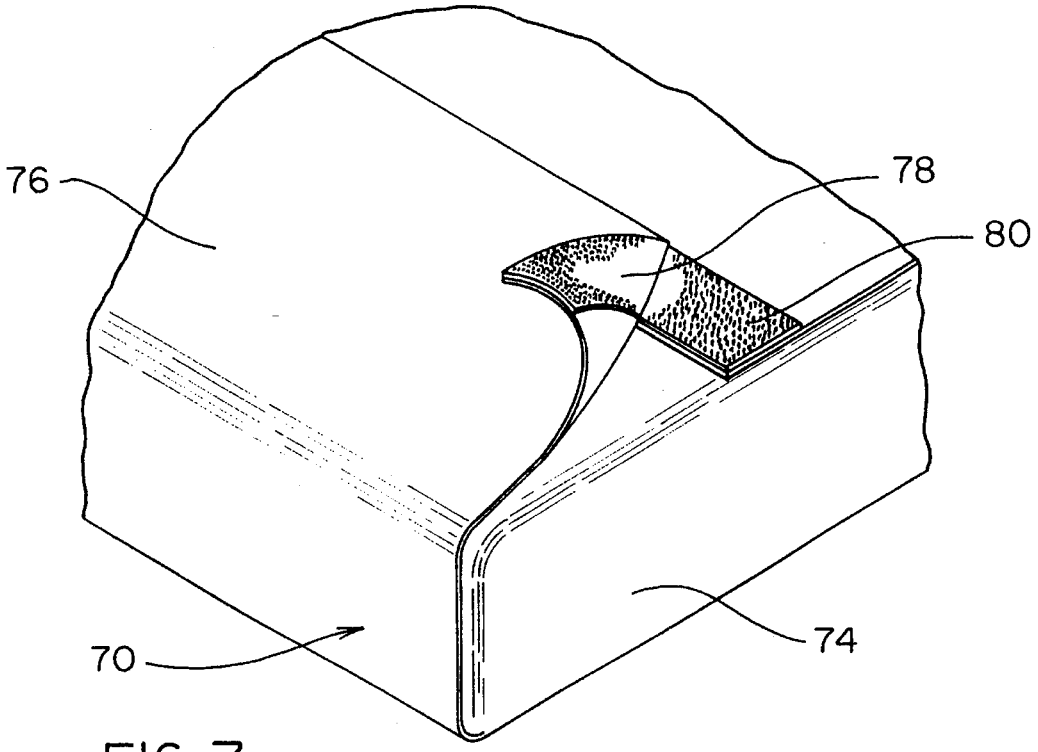
FIG. 7 is a fragmentary perspective view of the pillow support devices showing an installed outer covering.
Figure 8:
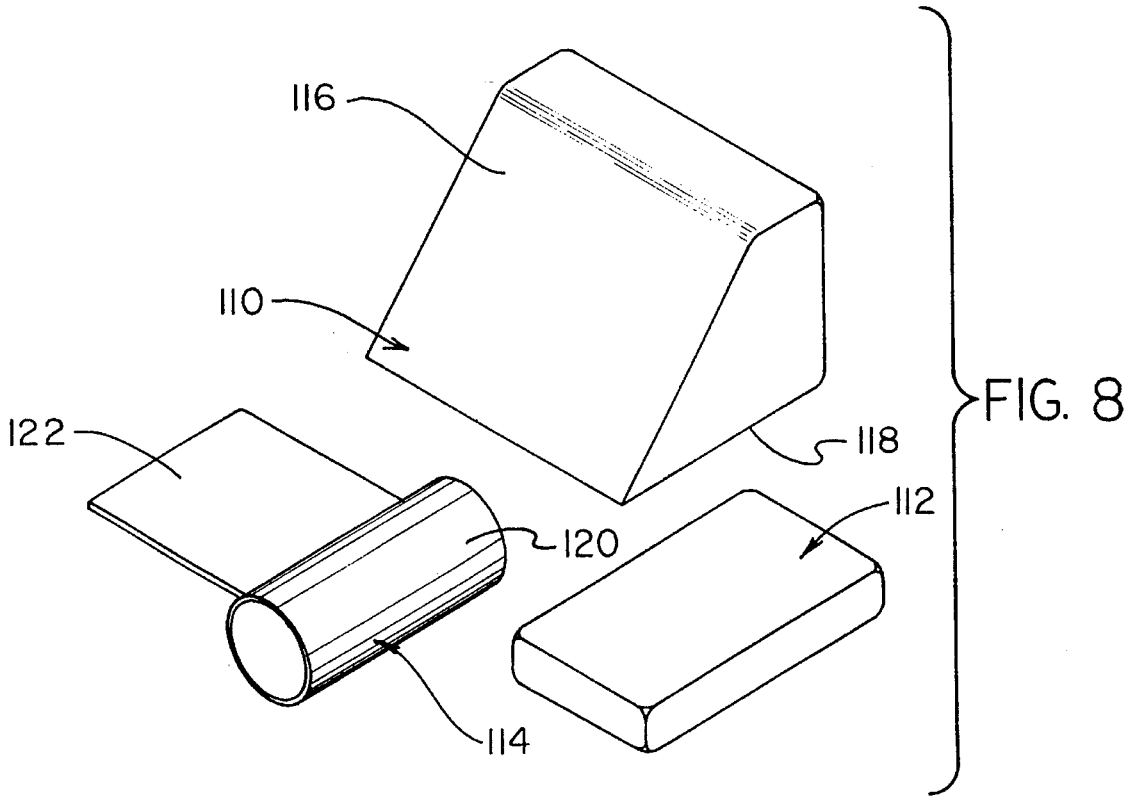
FIG. 8 is a perspective view of a plurality of differing pillow support devices showing various functional designs.

Exterior fabriclike covering 70 comprises a substantially cross shaped member of thin, flexible, fabriclike composition. See FIG. 6. Fabriclike covering 70 comprises a first tablike portion 72 and an equivalent second tablike portion 74 disposed upon either side of a central flap portion 76 upon which a first coacting adhesive member 78 and a second coacting adhesive member 80 are disposed along an engageable edge portion thereof. First tablike portion 72 has a first foldable edge portion 82, an angular cut 84, and a slit 86 disposed therein. First tablike portion 72 additionally has a second foldable edge portion 90, an angular cut 92, and a slit 94 disposed therein. Second tablike portion 74 has a first foldable edge portion 96, an angular cut 98, and a slit 100 disposed therein. And second tablike portion 74 has a second foldable edge portion 102, an angular cut 104, and a slit 106 disposed therein. Exterior fabriclike covering 70 is wrappedly disposed over core 20 and first coacting adhesive member 78 is caused to engage second coacting adhesive member 80. First coacting adhesive member 78 comprises a pile section and second coacting adhesive member 80 comprises a plurality of tiny hooklike members which engage the pile section and provides a releasable adhesion thereto.

The pillow support devices 10 may be configured in a wedgelike shape 110, a rectangular pillowlike shape 112, and a skirted cylindrical shape 114. Wedgelike shape 110 provides support for a post surgery patient who after being supine for a time is required to lie somewhat on a side. Wedgelike shape 110 comprises a pillowlike covered support having a plane containing a first surface 116 angularly disposed to a plane containing a second surface 118 at angles ranging from twenty five degrees to ninety degrees. All remaining surfaces are wither parallely or orthogonally disposed to the second surface 118. Rectangular pillowlike shape 112 comprises an elongated enthickened firm pillowlike covered support devised to be placed between a post surgery patient's legs for maintenance separation thereof, or for being held firmly against the abdomen during coughing by patients recovering from abdominal surgery. Rectangular pillowlike shape 112 may be six inches to twenty four inches in length and six inches to twelve inches in width whereby patients having differing needs may select a suitable size therefrom. Skirted cylindrical shape 114 comprises a substantially rigid covered cylindrical pillowlike core 120 having a thin sheetlike skirt member 122 thereattached. Skirt member 122 comprises a thin flexible fabriclike member or an extension of an outermost covering of core 120. Skirted cylindrical shape 114 is employed to support infants on their side to preclude choking by laying their body upon skirt member 122 resting their back against covered core 120. Core 120 may range in diameter from three inches to ten inches and length may range to fourteen inches thereby providing a wide selection for various infant sizes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A pillow support device for post surgery support of human body portions comprising:

a substantially rigid foam pillow member;

a substantially impermeable membranous first covering layer disposed over all portions of said pillow member, the first covering layer comprised a polymeric film formed into a pouch-like member having said pillow member insertably disposed therein and furthermore a closure sealably inclosing said pillow member therein is provided as a flap portion having strip adhesives disposed upon free edges thereof, the strip adhesives comprise a pressure sensitive adhesive layer and a strippable protective covering which is removably disposed thereon, whereby upon use the protective covering is removed exposing the adhesive layer for pressure induced application to other portions of said impermeable membranous first covering layer; and a flexible fabric second covering layer removably disposed over said impermeable first covering layer, the second covering layer comprises a washable fabric wrapped around said impermeable first covering layer and said pillow member and is releasably secured therearound by a coating adhesive means wherein said coating adhesive means comprises a pile section adhering to a first portion of said second covering layer and a plurality of minute hook members adhering to a second portion of said second covering layer whereby said pile section and said hook members releasably connect.

* * * * *